US010046950B2

(12) United States Patent
Nawata

(10) Patent No.: US 10,046,950 B2
(45) Date of Patent: Aug. 14, 2018

(54) TRUSS SUPPORT DEVICE FOR PASSENGER CONVEYOR

(71) Applicant: MITSUBISHI ELECTRIC CORPORATION, Chiyoda-ku (JP)

(72) Inventor: Masahiko Nawata, Chiyoda-ku (JP)

(73) Assignee: MITSUBISHI ELECTRIC CORPORATION, Chiyoda-ku (JP)

( * ) Notice: Subject to any disclaimer, the term of this patent is extended or adjusted under 35 U.S.C. 154(b) by 0 days.

(21) Appl. No.: 15/735,229

(22) PCT Filed: Aug. 11, 2015

(86) PCT No.: PCT/JP2015/072787

§ 371 (c)(1),
(2) Date: Dec. 11, 2017

(87) PCT Pub. No.: WO2017/026053

PCT Pub. Date: Feb. 16, 2017

(65) Prior Publication Data

US 2018/0179025 A1 Jun. 28, 2018

(51) Int. Cl.

| | |
|---|---|
| ***B66B 21/02*** | (2006.01) |
| ***B66B 23/00*** | (2006.01) |
| *B66B 21/04* | (2006.01) |

(52) U.S. Cl.
CPC ..... *B66B 23/00* (2013.01); *B66B 21/02* (2013.01); *B66B 21/04* (2013.01)

(58) Field of Classification Search
CPC ..... B66B 21/02; B66B 21/04; B66B 21/10; B66B 23/00

(Continued)

(56) References Cited

U.S. PATENT DOCUMENTS 6,129,198 A * 10/2000 Nusime ..... B66B 23/00 198/321
6,374,981 B1 * 4/2002 Gschwendtner ..... B66B 23/00 198/321

(Continued)

FOREIGN PATENT DOCUMENTS

JP 50-021277 Y 6/1975
JP 09-132186 A 5/1997

(Continued)

OTHER PUBLICATIONS

International Search Report dated Nov. 10, 2015 in PCT/JP2015/072787, filed on Aug. 11, 2015.

*Primary Examiner* — James R Bidwell
(74) *Attorney, Agent, or Firm* — Oblon, McClelland, Maier & Neustadt, L.L.P.

(57) ABSTRACT

A pair of displacement restricting members are fixed to a support member. When the support member is viewed from above, the displacement restricting members include reference end portions, respectively, which are positioned on a setting straight line set on an upper surface of the support member. The pair of displacement restricting members is fixed to the upper surface of the support member so that the reference end portions are directed in directions opposite to each other in a direction along the setting straight line. The end portion of the truss includes a pair of abutment surfaces facing the reference end portions, respectively. A gap is present in at least any one of a region between the reference end portion of one displacement restricting member and one abutment surface and a region between the reference end portion of the other displacement restricting member and the other abutment surface.

2 Claims, 15 Drawing Sheets

(58) Field of Classification Search
USPC ..... 198/321, 326
See application file for complete search history.

(56) References Cited

U.S. PATENT DOCUMENTS

| | | | | |
|---|---|---|---|---|
| 6,637,580 | B1 * | 10/2003 | Sneed | B65G 21/00 198/326 |
| 9,254,986 | B2 * | 2/2016 | Inoue | B66B 21/02 |
| 2003/0102198 | A1 * | 6/2003 | Nusime | B66B 21/00 198/321 |
| 2006/0254878 | A1 * | 11/2006 | Krampl | B66B 23/00 198/321 |
| 2014/0326577 | A1 * | 11/2014 | Inoue | B66B 23/14 198/326 |
| 2015/0090557 | A1 | 4/2015 | Inoue | |

FOREIGN PATENT DOCUMENTS

| | | | |
|---|---|---|---|
| JP | 2011-063389 | A | 3/2011 |
| JP | 2014-012562 | A | 1/2014 |
| JP | 2014-51372 | A | 3/2014 |
| JP | 2015-168489 | A | 9/2015 |
| WO | 2013/190675 | A1 | 12/2013 |

* cited by examiner

TRUSS SUPPORT DEVICE FOR PASSENGER CONVEYOR

TECHNICAL FIELD

The present invention relates to a truss support device for a passenger conveyor, which is configured to support end portions of a truss of a passenger conveyor.

BACKGROUND ART

Hitherto, there has been known a truss support device for a passenger conveyor, in which end portions of a truss are mounted on a bearing plate arranged on a building portion, and a pair of stopper members are arranged at positions of sandwiching the end portions of the truss in a width direction of the truss, to thereby regulate a displacement of the end portions of the truss in the width direction while allowing a displacement of the end portions of the truss in a longitudinal direction. The pair of stopper members are fixed to the bearing plate by being arranged along side surfaces of the end portions of the truss in the width direction under a state of being brought into contact with the side surfaces of the end portions of the truss in the width direction (see Patent Literature 1).

CITATION LIST

Patent Literature

[PTL 1] JP 2014-51372 A

SUMMARY OF INVENTION

Technical Problem

When a building is shaken by, for example, an earthquake or strong wind, and an upper building portion is displaced in the width direction of the truss with respect to a lower building portion, a horizontal displacement, that is, an interlayer displacement occurs between the upper building portion having upper end portions of the truss mounted thereon and the lower building portion having lower end portions of the truss mounted thereon. In this case, when the truss is viewed from above, the truss is inclined with respect to a position of an original longitudinal center line of the truss.

However, in the truss support device for a passenger conveyor described in Patent Literature 1, the pair of stopper members are brought into contact with the side surfaces of the truss in the width direction from both sides in upper end portions and lower end portions of the truss, and hence the inclination of the truss is inhibited in the upper end portions and the lower end portions of the truss, with the result that torsion or the like occurs in the truss. With this, there is a risk in that the truss and the stopper members may be broken.

The present invention has been made to solve the above-mentioned problem, and an object of the present invention is to provide a truss support device for a passenger conveyor, which is capable of preventing breakage of a truss and displacement restricting members.

Solution to Problem

According to one embodiment of the present invention, there is provided a truss support device for a passenger conveyor, which is configured to support an end portion of a truss of a passenger conveyor, the truss support device including: a support member being fixed to a building portion and having the end portion of the truss mounted thereon; and a pair of displacement restricting members including receiving portions, respectively, and being fixed to the support member, in which, when the support member is viewed from above, the receiving portions include reference end portions, respectively, which are positioned on a setting straight line set on an upper surface of the support member, in which the pair of displacement restricting members are fixed to the upper surface of the support member so that the reference end portions are directed in directions opposite to each other in a direction along the setting straight line, in which the end portion of the truss include a pair of abutment surfaces facing the reference end portions, respectively, in which, when the support member is viewed from above, each of the receiving portions has a dimension in a direction orthogonal to the setting straight line, which continuously decreases toward each of the reference end portions, and in which the truss support device for a passenger conveyor has a gap in at least any one of a region between the reference end portion of one of the pair of displacement restricting members and one of the pair of abutment surfaces and a region between the reference end portion of another of the pair of displacement restricting members and another of the pair of abutment surfaces.

Further, according to one embodiment of the present invention, there is provided a truss support device for a passenger conveyor, which is configured to support an end portion of a truss of a passenger conveyor, the truss support device including: a support member being fixed to a building portion and having the end portion of the truss mounted thereon; and a pair of displacement restricting members being fixed to the support member, in which the pair of displacement restricting members include foundation portions and protruding portions, respectively, each of the protruding portions protruding from a part of a side surface of each of the foundation portions, in which, when the support member is viewed from above, the protruding portions are reference end portions, respectively, which are positioned on a setting straight line set on an upper surface of the support member, in which the pair of displacement restricting members are fixed to the upper surface of the support member so that the reference end portions are directed in directions opposite to each other in a direction along the setting straight line, in which the end portion of the truss include a pair of abutment surfaces facing the reference end portions, respectively, and in which the truss support device for a passenger conveyor has a gap in at least any one of a region between the reference end portion of one of the pair of displacement restricting members and one of the pair of abutment surfaces and a region between the reference end portion of another of the pair of displacement restricting members and another of the pair of abutment surfaces.

Advantageous Effects of Invention

With the truss support device for a passenger conveyor according to the present invention, even when the building portion is displaced in a direction in which the truss is horizontally inclined, inhibition of the horizontal inclination of the truss by each of the displacement restricting members can be avoided, and torsion or the like of the truss can be prevented from being caused by each of the displacement restricting members. Thus, the breakage of the truss and each of the displacement restricting members can be prevented.

DESCRIPTION OF EMBODIMENTS

Now, description is given of preferred embodiments of the present invention with reference to the drawings.

Figure 1:
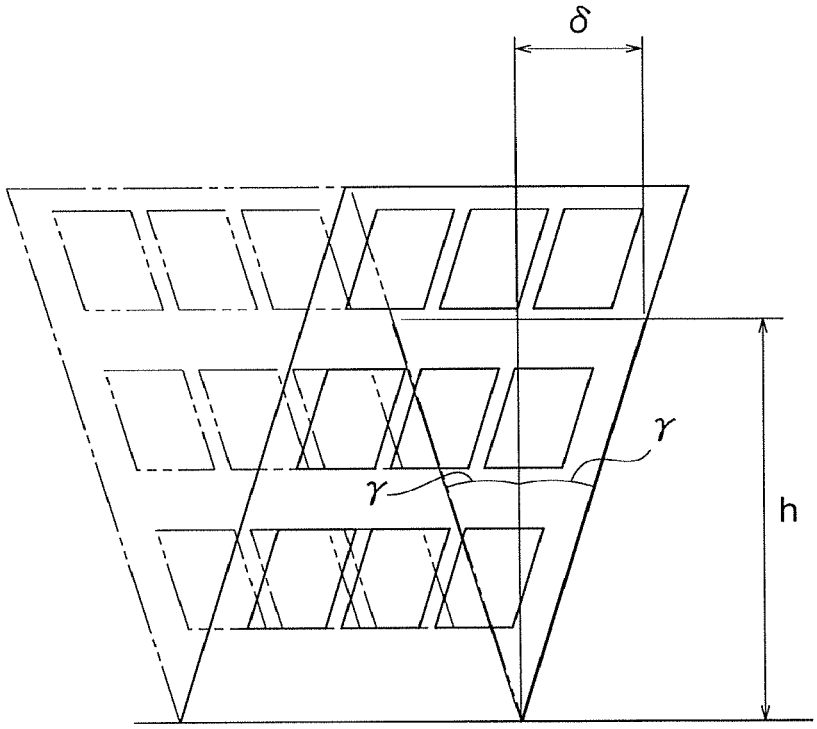
FIG. 1 is a schematic view of a building in which an escalator according to a first embodiment of the present invention is installed.

FIG. 1 is a schematic view for illustrating a building in which an escalator of a first embodiment of the present invention is installed. An interlayer deformation angle $\gamma$ of the building is set to be equal to or less than a certain defined value. The interlayer deformation angle $\gamma$ of the building is determined based on a value obtained by dividing a horizontal displacement $\delta$ at an X-point of the building, when the building is shaken by, for example, an earthquake or strong wind, by a height h from a lower end of the building to the X-point. The escalator being a passenger conveyor is installed in the building in which the interlayer deformation angle $\gamma$ is set to be equal to or less than the certain defined value.

Figure 2:
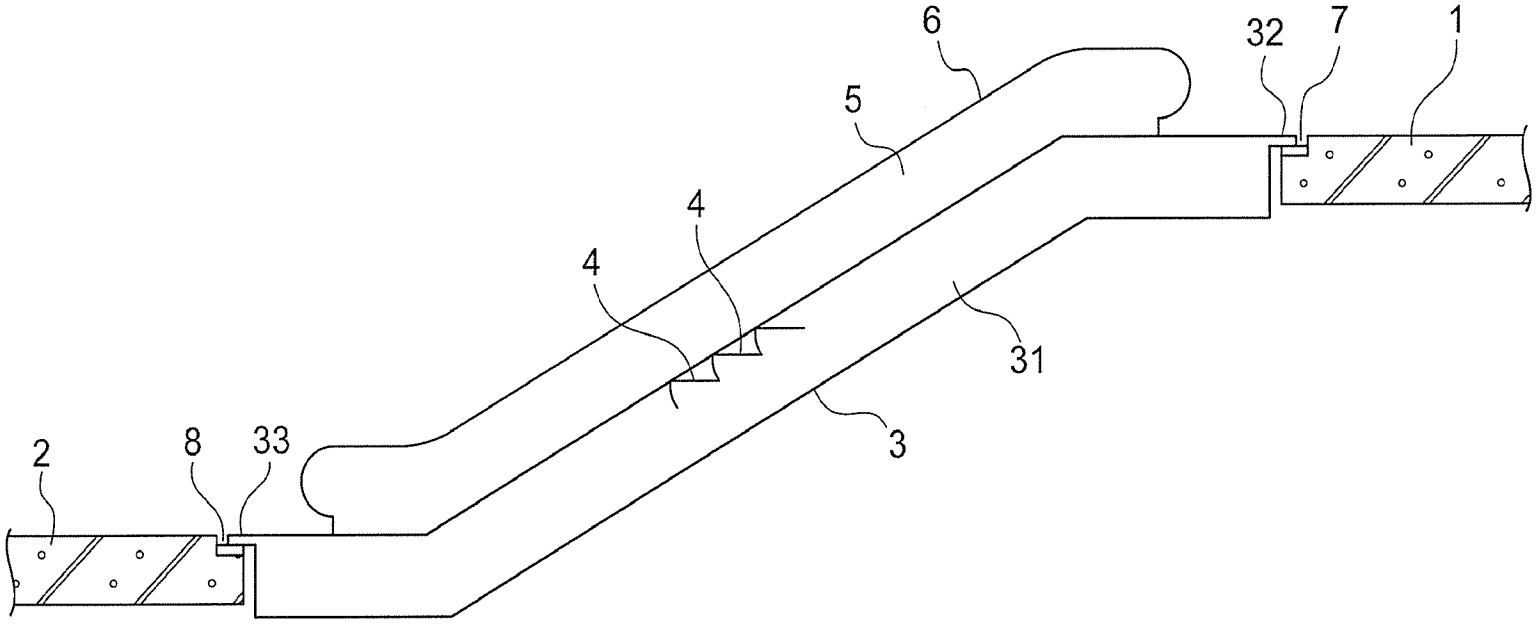
FIG. 2 is a side view for illustrating the escalator according to the first embodiment of the present invention.

FIG. 2 is a side view for illustrating the escalator according to the first embodiment of the present invention. In FIG. 2, a truss 3 of the escalator is installed between an upper building portion 1 arranged on an upper floor in the building and a lower building portion 2 arranged on a lower floor that is lower than the floor of the upper building portion 1. The truss 3 is configured to support a plurality of steps 4 connected to each other in an endless shape. Each of the steps 4 is circulated and moved between the upper building portion 1 and the lower building portion 2 with a drive force of a driver (not shown) installed in the truss 3. A pair of balustrades 5 are arranged on the truss at both end portions thereof in a width direction of the truss 3. A moving handrail 6 configured to move in synchronization with the steps 4 is arranged on an outer peripheral portion of each of the balustrades 5.

Figure 3:
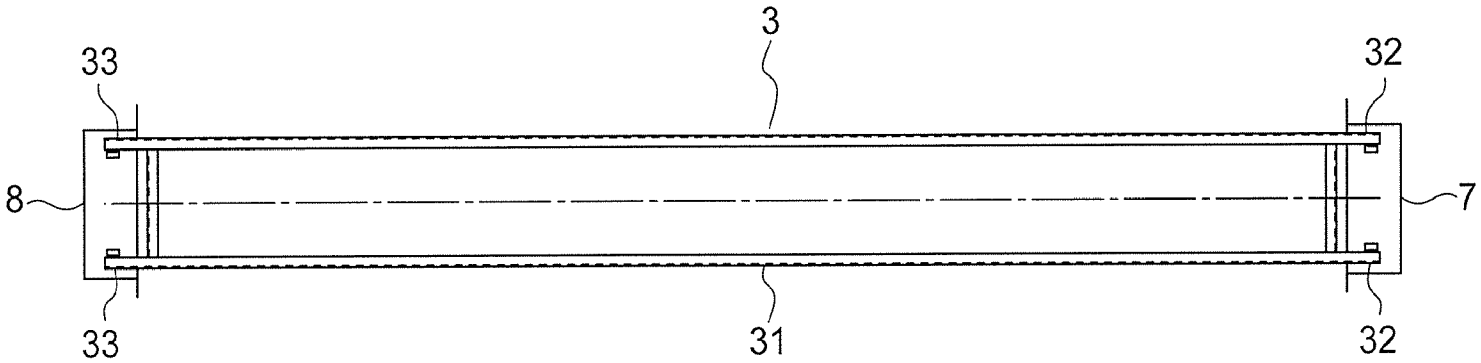
FIG. 3 is a top view for illustrating a state of a truss of FIG. 2 when viewed from above.

FIG. 3 is a top view for illustrating a state of the truss 3 of FIG. 2 when viewed from above. The truss 3 includes a truss main body 31 formed of a plurality of angle bars, a pair of upper engaging portions 32 protruding as upper end portions of the truss 3 from one longitudinal end portion of the truss main body 31, and a pair of lower engaging portions 33 protruding as lower end portions of the truss 3 from the other longitudinal end portion of the truss main body 31. The pair of upper engaging portions 32 are arranged so as to be separated from each other in the width direction of the truss 3 and are arranged along a longitudinal direction of the truss 3. The pair of lower engaging portions 33 are also arranged so as to be separated from each other in the width direction of the truss 3 and arranged along the longitudinal direction of the truss 3.

An upper truss support device 7 is arranged on the upper building portion 1, and a lower truss support device 8 is arranged on the lower building portion 2. The pair of upper engaging portions 32 being the upper end portions of the truss 3 are supported by the upper truss support device 7, and the pair of lower engaging portions 33 being the lower end portions of the truss 3 are supported by the lower truss support device 8.

Figure 4:
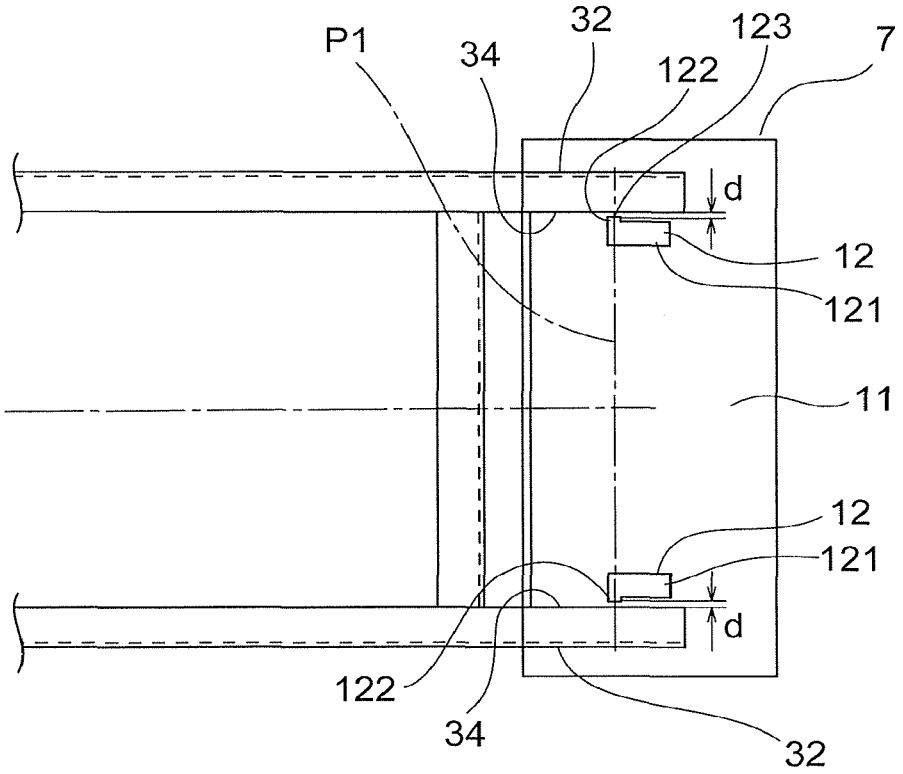
FIG. 4 is a top view for illustrating upper end portions of the truss and an upper truss support device of FIG. 2.
Figure 5:
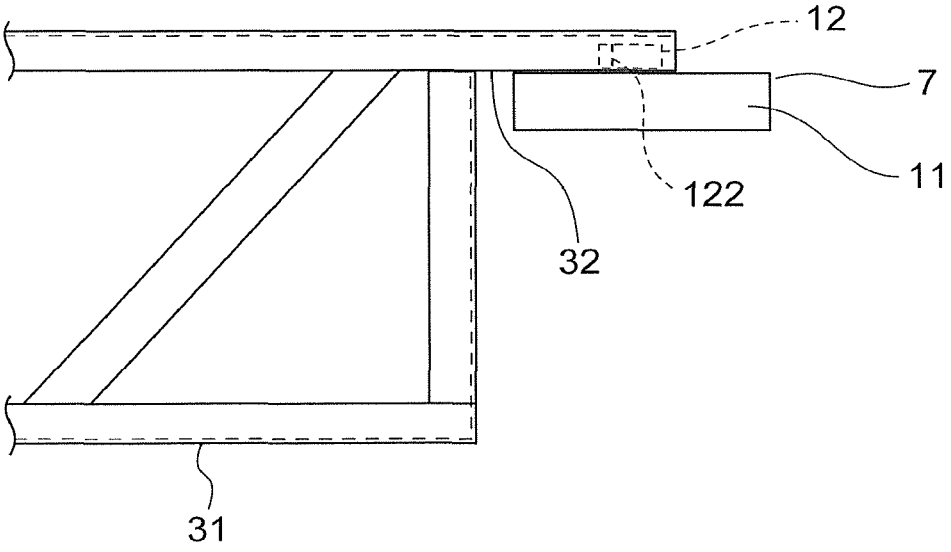
FIG. 5 is a side view for illustrating the upper end portions of the truss and the upper truss support device of FIG. 4.

FIG. 4 is a top view for illustrating the upper end portions of the truss 3 and the upper truss support device 7 of FIG. 2. Further, FIG. 5 is a side view for illustrating the upper end portions of the truss 3 and the upper truss support device 7 of FIG. 4. The upper truss support device 7 includes a bearing plate 11 being a support member fixed to the upper building portion 1, and a pair of stopper members 12 being a pair of displacement restricting members which are fixed to the upper surface of the bearing plate 11 and which are configured to restrict the displacement of the pair of upper engaging portions 32 in the width direction of the truss 3.

The pair of upper engaging portions 32 are mounted on the bearing plate 11. A setting straight line P1 is set on the upper surface of the bearing plate 11. The truss 3 is arranged under a state in which the width direction of the truss 3 is matched with a direction along the setting straight line P1.

The pair of stopper members 12 are arranged so as to be separated from each other in the direction along the setting straight line P1. Further, each of the pair of stopper members 12 includes a foundation portion 121 fixed to the bearing plate 11 and a protruding portion 122 protruding from a part of a side surface of the foundation portion 121. With this, when the bearing plate 11 is viewed from above, the stopper member 12 has a stair-like shape by virtue of the foundation portion 121 and the protruding portion 122. The stopper member 12 may be formed as a single member by integrally forming the foundation portion 121 and the protruding portion 122 or may be formed by forming the foundation portion 121 and the protruding portion 122 as separate members and thereafter integrating the foundation portion 121 and the protruding portion 122 with each other.

The foundation portion 121 has a rectangular box shape. When the bearing plate 11 is viewed from above, the foundation portion 121 is arranged so that a side surface of the rectangular box of the foundation portion 121 is orthogonal to the setting straight line P1.

The protruding portion 122 is formed on the foundation portion 121 as a reference end portion of the stopper member 12. When the bearing plate 11 is viewed from above, the dimension of the protruding portion 122 in a direction orthogonal to the setting straight line P1 is equal at any position in the direction along the setting straight line P1. In this example, the protruding portion 122 protrudes along the setting straight line P1 from an end portion of the foundation portion 121 on the truss main body 31 side. When the bearing plate 11 is viewed from above, the protruding portion 122 is positioned on the setting straight line P1.

The protruding portion 122 is formed along a height direction of the foundation portion 121. Further, a height position of an upper surface of the protruding portion 122 is matched with a height position of an upper surface of the foundation portion 121. The protruding portion 122 has a rectangular box shape along the height direction of the foundation portion 121. With this, an end surface 123 being a flat surface orthogonal to the setting straight line P1 is formed on the protruding portion 122.

The pair of stopper members 12 are fixed to the upper surface of the bearing plate 11 so that the protruding portions 122 are directed in directions opposite to each other in the direction along the setting straight line P1. In this example, the pair of stopper members 12 are fixed to the upper surface of the bearing plate 11 so that the protruding portions 122 are directed outward in the direction along the setting straight line P1. The pair of stopper members 12 are arranged between the pair of upper engaging portions 32. That is, the pair of stopper members 12 are arranged on inner sides of the pair of upper engaging portions 32 in the direction along the setting straight line P1.

A pair of abutment surfaces 34 facing the pair of protruding portions 122, respectively, are formed on the pair of upper engaging portions 32. That is, one abutment surface 34 facing the protruding portion 122 of one stopper member 12 is formed on one upper engaging portion 32, and the other abutment surface 34 facing the protruding portion 122 of the other stopper member 12 is formed on the other upper engaging portion 32. With this, the pair of abutment surfaces 34 are directed to an inner side of the truss 3 in the width direction of the truss 3.

The pair of abutment surfaces 34 are orthogonal to the width direction of the truss 3. The truss 3 is arranged under a state in which the pair of abutment surfaces 34 are orthogonal to the setting straight line P1. In this example, the end surface 123 of the protruding portion 122 is a flat surface. Therefore, when the abutment surface 34 is brought into contact with the protruding portion 122 under a state in which the abutment surface 34 is orthogonal to the setting straight line P1, the abutment surface 34 is put into a surface contact state with respect to the protruding portion 122.

Gaps d are present between the protruding portion 122 of the one stopper member 12 and the one abutment surface 34 and between the protruding portion 122 of the other stopper member 12 and the other abutment surface 34, respectively. In this example, the sizes of the gaps d are equal to each other. In the upper truss support device 7, a gap between the foundation portion 121 and the abutment surface 34 is larger than the gap d between the protruding portion 122 and the abutment surface 34. The size of each of the gaps d in the upper truss support device 7 is set to be from 3 mm to 5 mm for a building having the interlayer deformation angle $\gamma$ of from $1/24$ to $1/40$.

Figure 6:
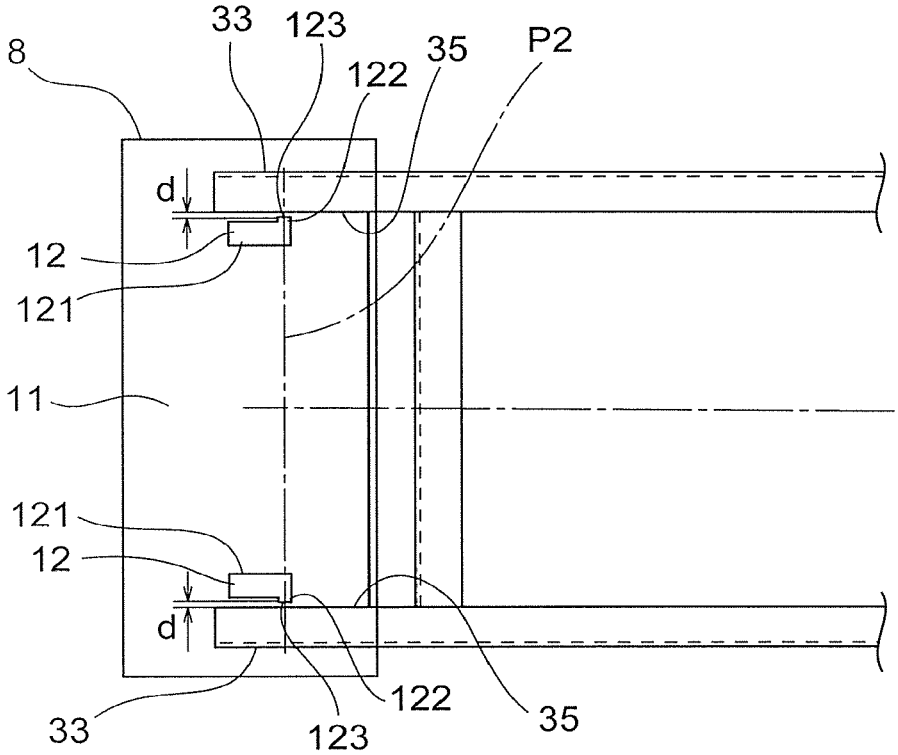
FIG. 6 is a top view for illustrating lower end portions of the truss and a lower truss support device of FIG. 2.
Figure 7:
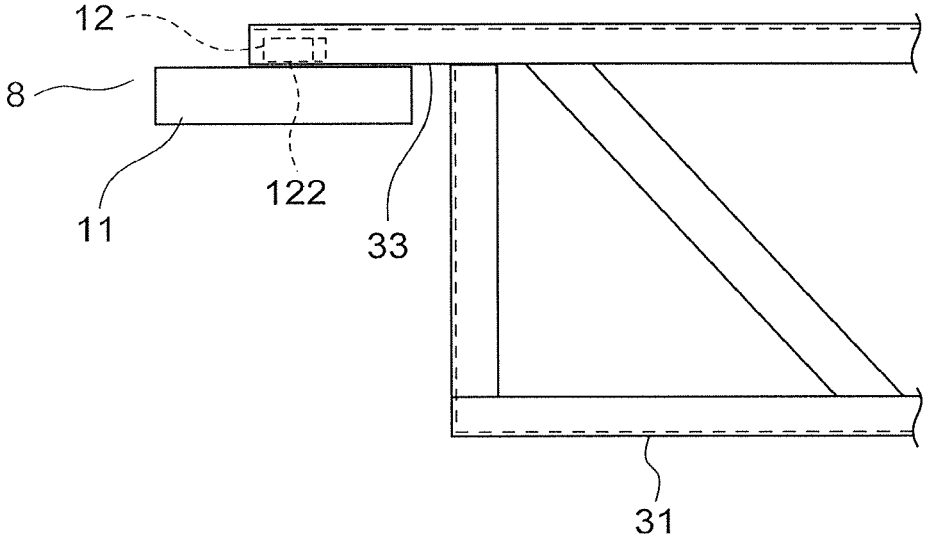
FIG. 7 is a side view for illustrating the lower end portions of the truss and the lower truss support device of FIG. 6.

FIG. 6 is a top view for illustrating the lower end portions of the truss 3 and the lower truss support device 8 of FIG. 2. Further, FIG. 7 is a side view for illustrating the lower end portions of the truss 3 and the lower truss support device 8 of FIG. 6. The configuration of the lower truss support device 8 is the same as that of the upper truss support device 7 except that a semi-fixing mechanism portion (not show) is arranged. The semi-fixing mechanism portion is a mechanism portion configured to maintain fixing of the pair of lower engaging portions 33 with respect to the lower truss support device 8 under an exciting force having a certain value or less caused by a small-scale earthquake and a medium-scale earthquake, but to enable a displacement of the pair of lower engaging portions 33 with respect to the lower truss support device 8 under an exciting force of more than the certain value caused by a large-scale earthquake.

In the lower truss support device 8, a setting straight line P2 is set on the upper surface of the bearing plate 11. The positional relationship of the pair of stopper members 12 of the lower truss support device 8 with respect to the setting straight line P2 is the same as that of the pair of stopper members 12 of the upper truss support device 7 with respect to the setting straight line P1.

The truss 3 is arranged under a state in which the width direction of the truss 3 is matched with a direction along the setting straight line P2. In the lower truss support device 8, the pair of stopper members 12 are arranged between the pair of lower engaging portions 33. That is, the pair of stopper members 12 are arranged on inner sides of the pair of lower engaging portions 33 in the direction along the setting straight line P2. Further, in the lower truss support device 8, the pair of stopper members 12 are fixed to the upper surface of the bearing plate 11 so that the protruding portions 122 being the reference end portions are directed in directions opposite to each other (outward in this example) in the direction along the setting straight line P2.

A pair of abutment surfaces 35 facing the pair of protruding portions 122 of the lower truss support device 8 are formed on the pair of lower engaging portions 33. That is, one abutment surface 35 facing the protruding portion 122 of the one stopper member 12 of the lower truss support device 8 is formed on one lower engaging portion 33, and the other abutment surface 35 facing the protruding portion 122 of the other stopper member 12 of the lower truss support device 8 is formed on the other lower engaging portion 33. The pair of abutment surfaces 35 are directed to the inner side of the truss 3 in the width direction of the truss 3.

The pair of abutment surfaces 35 are orthogonal to the width direction of the truss 3. The truss 3 is arranged under a state in which the pair of abutment surfaces 35 are orthogonal to the setting straight line P2. In the lower truss support device 8, the end surface 123 of the protruding portion 122 is a flat surface. Therefore, when the abutment surface 35 is brought into contact with the protruding portion 122 under a state in which the abutment surface 35 is orthogonal to the setting straight line P2, the abutment surface 35 is put into a surface contact state with respect to the protruding portion 122.

Further, in the lower truss support device 8, the gaps d are present between the protruding portion 122 of the one stopper member 12 and the one abutment surface 35 and between the protruding portion 122 of the other stopper member 12 and the other abutment surface 35, respectively. In this example, the sizes of the gaps d in the lower truss support device 8 are equal to each other. Further, also in the lower truss support device 8, similarly to the upper truss support device 7, a gap between the foundation portion 121 and the abutment surface 35 is larger than the gap d between the protruding portion 122 and the abutment surface 35. The size of each of the gaps d in the lower truss support device 8 is set to be from 3 mm to 5 mm for the building having the interlayer deformation angle $\gamma$ of from $1/24$ to $1/40$.

Figure 8:
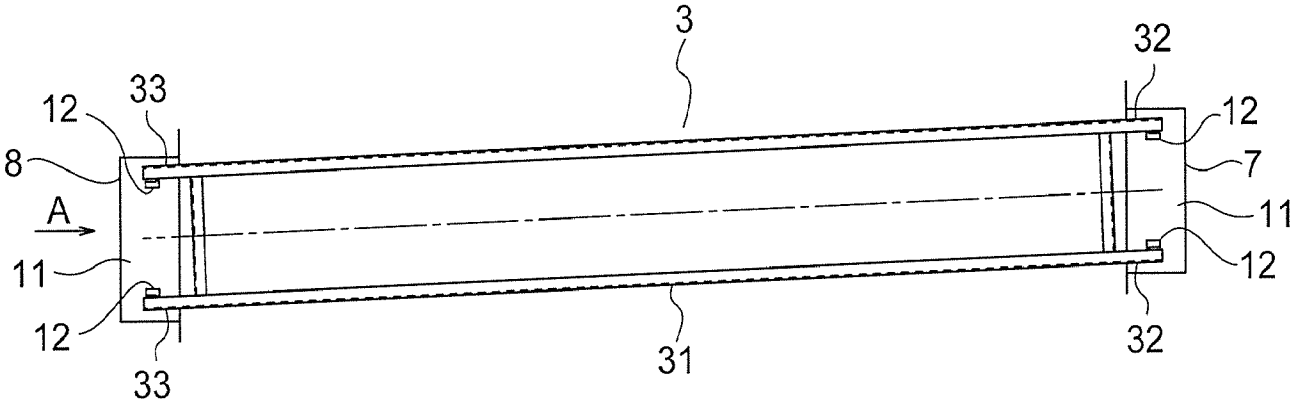
FIG. 8 is a top view for illustrating a state of the truss when an interlayer displacement occurs between an upper building portion and a lower building portion.
Figure 9:
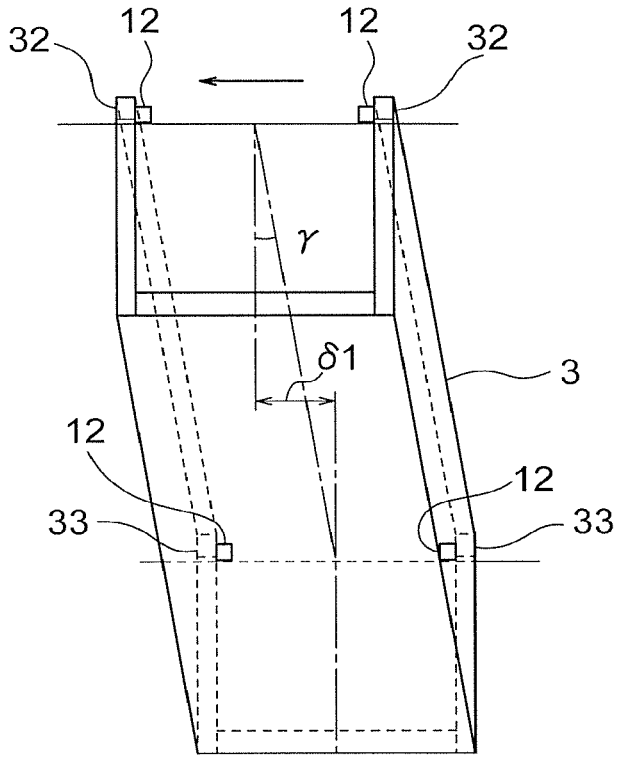
FIG. 9 is a front view for illustrating the truss when viewed along the arrow A of FIG. 8.

Next, description is given of an operation when an interlayer displacement occurs between the upper building portion 1 and the lower building portion 2 due to, for example, an earthquake or strong wind. FIG. 8 is a top view for illustrating a state of the truss 3 when the interlayer displacement occurs between the upper building portion 1 and the lower building portion 2. Further, FIG. 9 is a front view for illustrating the truss 3 when viewed along the arrow A of FIG. 8. When the interlayer deformation angle reaches the value of $\gamma$ due to the deformation of the building caused by, for example, an earthquake or strong wind, the upper building portion 1 may be displaced by a distance 51 in a horizontal direction along the setting straight lines P1 and P2 with respect to the lower building portion 2 to cause the interlayer displacement. When the upper building portion 1 is displaced in the direction along the setting straight lines P1 and P2 with respect to the lower building portion 2, the truss 3 when viewed from above is inclined with respect to each of the setting straight lines P1 and P2 as illustrated in FIG. 8.

Figure 10:
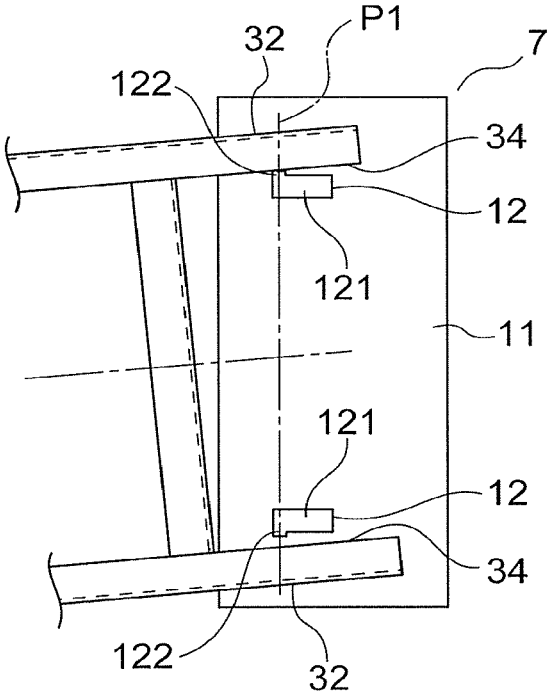
FIG. 10 is a top view for illustrating the upper end portions of the truss and the upper truss support device of FIG. 8.

FIG. 10 is a top view for illustrating the upper end portions of the truss 3 and the upper truss support device 7 of FIG. 8. In the upper truss support device 7, when the interlayer displacement of the upper building portion 1 with respect to the lower building portion 2 occurs, the protruding portion 122 of the one stopper member 12 is brought into contact with the abutment surface 34 of the one upper engaging portion 32, with the result that a distance between the protruding portion 122 of the other stopper member 12 and the other upper engaging portion 32 increases as compared to the distance in a normal state. When the displacement distance of the upper building portion 1 with respect to the lower building portion 2 further increases, the truss 3 rotates around a corner portion of the protruding portion 122 of the one stopper member 12, which is brought into contact with the abutment surface 34, and the truss 3 when viewed from above is inclined with respect to the setting straight line P1. In this case, in the upper truss support device 7, the truss 3 rotates around the corner portion of the protruding portion 122 of the one stopper member 12 while keeping a state in which the other upper engaging portion 32 is separated from the other stopper member 12.

Figure 11:
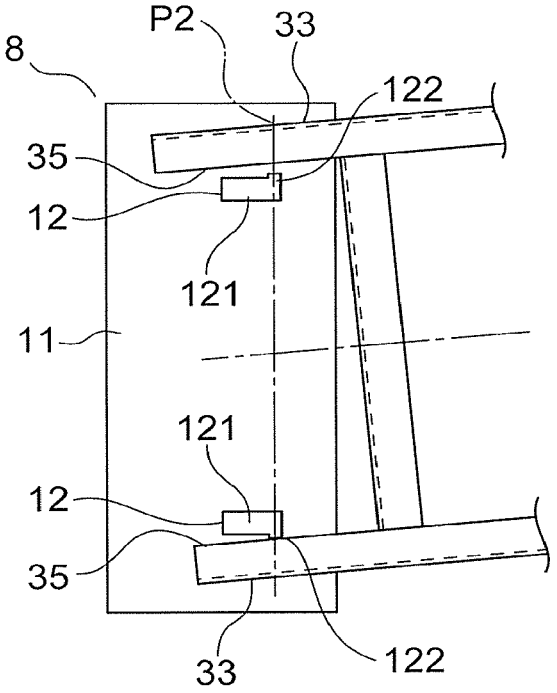
FIG. 11 is a top view for illustrating the lower end portions of the truss and the lower truss support device of FIG. 8.

FIG. 11 is a top view for illustrating the lower end portions of the truss 3 and the lower truss support device 8 of FIG. 8. In the lower truss support device 8, when the interlayer displacement of the upper building portion 1 with respect to the lower building portion 2 occurs, the protruding portion 122 of the other stopper member 12 arranged at a diagonal position to the one stopper member 12 of the upper truss support device 7 is brought into contact with the abutment surface 35 of the other lower engaging portion 33, with the result that a distance between the protruding portion 122 of the one stopper member 12 and the other lower engaging portion 33 increases as compared to the distance in a normal state. When the displacement distance of the upper building portion 1 with respect to the lower building portion 2 further increases, the truss 3 rotates around a corner portion of the protruding portion 122 of the other stopper member 12, which is brought into contact with the abutment surface 35, and the truss 3 when viewed from above is inclined with respect to the setting straight line P2. In this case, in the lower truss support device 8, the truss 3 rotates around the corner portion of the protruding portion 122 of the other stopper member 12 while keeping a state in which the one lower engaging portion 33 is separated from the one stopper member 12.

As described above, when the interlayer displacement of the upper building portion 1 with respect to the lower building portion 2 occurs, each of the upper engaging portions 32 and each of the lower engaging portions 33 rotate without being inhibited by each of the stopper members 12 in any of the upper truss support device 7 and the lower truss support device 8, and the truss 3 when viewed from above is inclined with respect to the setting straight lines P1 and P2.

In each of the upper truss support device 7 and the lower truss support device 8 as described above, the pair of stopper members 12 each include the foundation portion 121 and the protruding portion 122 protruding as the reference end portion from a part of the side surface of the foundation portion 121, and the gaps d are present between the protruding portion 122 of the one stopper member 12 and the one abutment surface 34 or 35 and between the protruding portion 122 of the other stopper member 12 and the other abutment surface 34 or 35, respectively. Therefore, the truss 3 can be horizontally inclined with respect to the setting straight lines P1 and P2 while avoiding each of the stopper members 12. With this, when the interlayer displacement of the upper building portion 1 with respect to the lower building portion 2 occurs, inhibition of the horizontal inclination of the truss 3 by each of the stopper members 12 can be avoided, and torsion or the like of the truss 3 can be prevented from being caused by each of the stopper members 12. Thus, the breakage of the truss 3 and each of the stopper members 12 can be prevented.

Further, the end surface 123 of the protruding portion 122 is a flat surface orthogonal to the direction along the setting straight line P1 or P2. Therefore, the protruding portion 122 can easily be formed and positioned, and the upper truss support device 7 and the lower truss support device 8 can easily be manufactured.

In the above-mentioned example, the protruding portion 122 protrudes from an end portion of a side surface of the foundation portion 121 on the truss main body 31 side. However, the protruding portion 122 may protrude from an end portion of the side surface of the foundation portion 121 on an opposite side to the truss main body 31, or the protruding portion 122 may protrude from a center portion of the side surface of the foundation portion 121.

Further, in the above-mentioned example, the end surface 123 of the protruding portion 122 of the upper truss support device 7 is a flat surface, but the end surface 123 of the protruding portion 122 may be a curved surface rising along the setting straight line P1. In this case, when the abutment surface 34 orthogonal to the setting straight line P1 is brought into contact with the end surface 123 of the protruding portion 122, the abutment surface 34 and the end surface 123 may be put into a line contact state along a height direction of the stopper member 12, or the abutment surface 34 and the end surface 123 may be put into a point contact state.

Further, in the above-mentioned example, the end surface 123 of the protruding portion 122 of the lower truss support device 8 is a flat surface, but the end surface 123 of the protruding portion 122 may be a curved surface rising along the setting straight line P2. In this case, when the abutment surface 35 orthogonal to the setting straight line P2 is brought into contact with the end surface 123 of the protruding portion 122, the abutment surface 35 and the end surface 123 may be put into a line contact state along the height direction of the stopper member 12, or the abutment surface 35 and the end surface 123 may be put into a point contact state.

Further, in the above-mentioned example, the pair of stopper members 12 of the upper truss support device 7 are arranged between the pair of upper engaging portions 32, but the pair of stopper members 12 may be arranged on outer sides of the pair of upper engaging portions 32 in the width direction. That is, the pair of upper engaging portions 32 may be inserted between the pair of stopper members 12. In this case, the pair of abutment surfaces 34 of the pair of upper engaging portions 32 are arranged so as to be directed to outer sides of the truss 3 in the width direction. Further, the pair of stopper members 12 are fixed to the upper surface of the bearing plate 11 so that the protruding portions 122 are directed inward in the direction along the setting straight line P1.

Further, in the above-mentioned example, the pair of stopper members 12 of the lower truss support device 8 are arranged between the pair of lower engaging portions 33, but the pair of stopper members 12 may be arranged on outer sides of the pair of lower engaging portions 33 in the width direction. That is, the pair of lower engaging portions 33 may be inserted between the pair of stopper members 12. In this case, the pair of abutment surfaces 35 of the pair of lower engaging portions 33 are arranged so as to be directed to the outer sides of the truss 3 in the width direction. Further, the pair of stopper members 12 are fixed to the upper surface of the bearing plate 11 so that the protruding portions 122 are directed inward in the direction along the setting straight line P2.

Further, in the above-mentioned example, the gaps d are present between the protruding portion 122 of the one stopper member 12 and the one abutment surface 34 or 35 and between the protruding portion 122 of the other stopper member 12 and the other abutment surface 34 or 35, respectively. However, the gap may be present only between the protruding portion 122 of the one stopper member 12 and the one abutment surface 34 or 35 or only between the protruding portion 122 of the other stopper member 12 and the other abutment surface 34 or 35.

Second Embodiment

Figure 12:
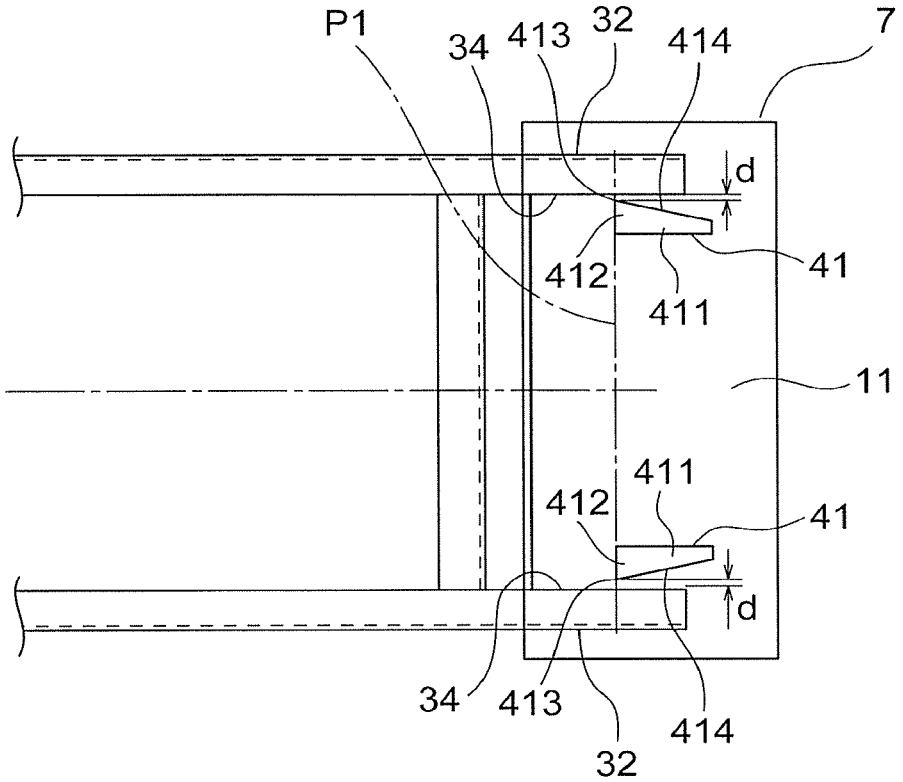
FIG. 12 is a top view for illustrating upper end portions of a truss of an escalator and an upper truss support device according to a second embodiment of the present invention.
Figure 13:
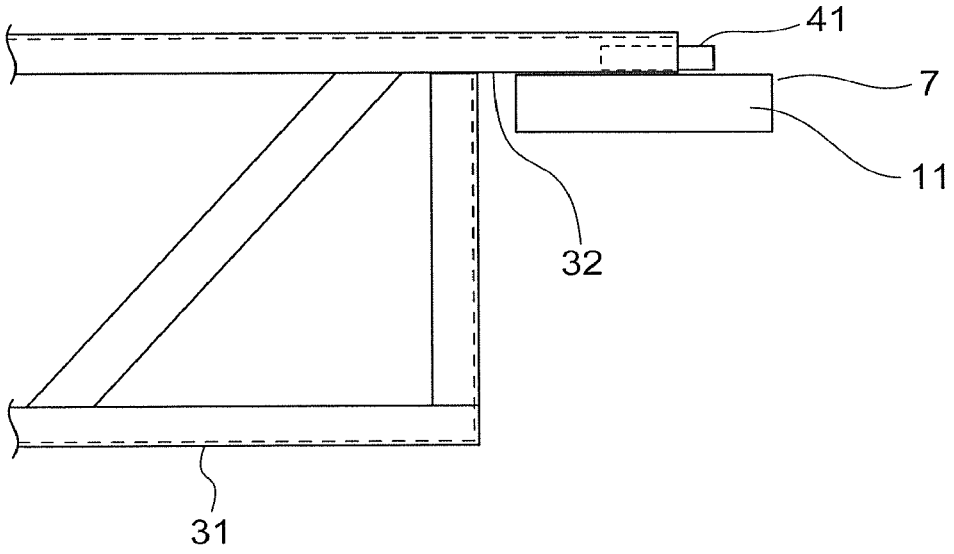
FIG. 13 is a side view for illustrating the upper end portions of the truss and the upper truss support device of FIG. 12.

FIG. 12 is a top view for illustrating upper end portions of a truss and an upper truss support device for an escalator according to a second embodiment of the present invention. Further, FIG. 13 is a side view for illustrating the upper end portions of the truss and the upper truss support device of FIG. 12. The upper truss support device 7 includes the bearing plate 11 being a support member and a pair of stopper members 41 being a pair of displacement restricting members fixed to the bearing plate 11. The configuration of the upper truss support device 7 is the same as that of the upper truss support device 7 according to the first embodiment except for the pair of stopper members 41.

The pair of stopper members 41 each include a main body portion 411 and a receiving portion 412 formed on a side surface of the main body portion 411. The stopper member 41 may be formed as a single member by integrally forming the main body portion 411 and the receiving portion 412 or may be formed by forming the main body portion 411 and the receiving portion 412 as separate members and thereafter integrating the main body portion 411 and the receiving portion 412 with each other. When the bearing plate 11 is viewed from above, the main body portion 411 is arranged so that a side surface of a rectangular box of the main body portion 411 is orthogonal to the setting straight line P1.

When the bearing plate 11 is viewed from above, the receiving portion 412 includes a reference end portion 413 positioned on the setting straight line P1. In the upper truss support device 7, when the bearing plate 11 is viewed from above, the dimensions of the main body portion 411 and the receiving portion 412 in the direction orthogonal to the setting straight line P1 become equal at a position of a boundary between the main body portion 411 and the receiving portion 412. Further, in the upper truss support device 7, when the bearing plate 11 is viewed from above, the dimension of the receiving portion 412 in the direction orthogonal to the setting straight line P1 continuously decreases toward the reference end portion 413.

The receiving portion 412 includes an inclined surface 414 inclined with respect to the setting straight line P1 and a reference flat surface along the setting straight line P1. When the bearing plate 11 is viewed from above, the inclined surface 414 is inclined in a direction separated from the setting straight line P1 from the reference end portion 413 to the main body portion 411. In this example, each of the inclined surface 414 and the reference flat surface is a flat surface orthogonal to the upper surface of the bearing plate 11, and the receiving portion 412 has a triangular prism shape. That is, in the stopper member 41, when the bearing plate 11 is viewed from above, an outline of the receiving portion 412 is formed of a straight line representing the reference flat surface overlapping the setting straight line P1 and a straight line representing the inclined surface 414 inclined with respect to the setting straight line P1. The reference end portion 413 forms a ridge line at which the reference flat surface overlapping the setting straight line P1 and the inclined surface 414 inclined with respect to the setting straight line P1 cross each other. With this, in the stopper member 41, when the bearing plate 11 is viewed from above, the outline of the receiving portion 412 is formed of two straight lines that cross each other at the reference end portion 413 on the setting straight line P1.

The pair of stopper members 41 are fixed to the upper surface of the bearing plate 11 so that the reference end portions 413 are directed in directions opposite to each other in the direction along the setting straight line P1. In this example, the pair of stopper members 41 are fixed to the upper surface of the bearing plate 11 so that the reference end portions 413 are directed outward in the direction along the setting straight line P1. The pair of stopper members 41 are arranged between the pair of upper engaging portions 32. In the receiving portion 412 of the upper truss support device 7, when the abutment surface 34 of the upper engaging portion 32 is brought into contact with the reference end portion 413, the abutment surface 34 and the reference end portion 413 are put into a line contact state.

The gaps d are present between the reference end portion 413 of one stopper member 41 and the one abutment surface 34 and between the reference end portion 413 of the other stopper member 41 and the other abutment surface 34, respectively. In this example, the sizes of the gaps d are equal to each other. In the upper truss support device 7, the inclined surface 414 is inclined with respect to the setting straight line P1. Therefore, the gap d between the abutment surface 34 and the reference end portion 413 is smallest, and the gap between the abutment surface 34 and the inclined surface 414 continuously increases as being separated from the reference end portion 413. The size of each of the gaps d in the upper truss support device 7 is set to be from 3 mm to 5 mm for a building having the interlayer deformation angle γ of from 1/24 to 1/40. The other configurations of the upper truss support device 7 are the same as those of the first embodiment.

Figure 14:
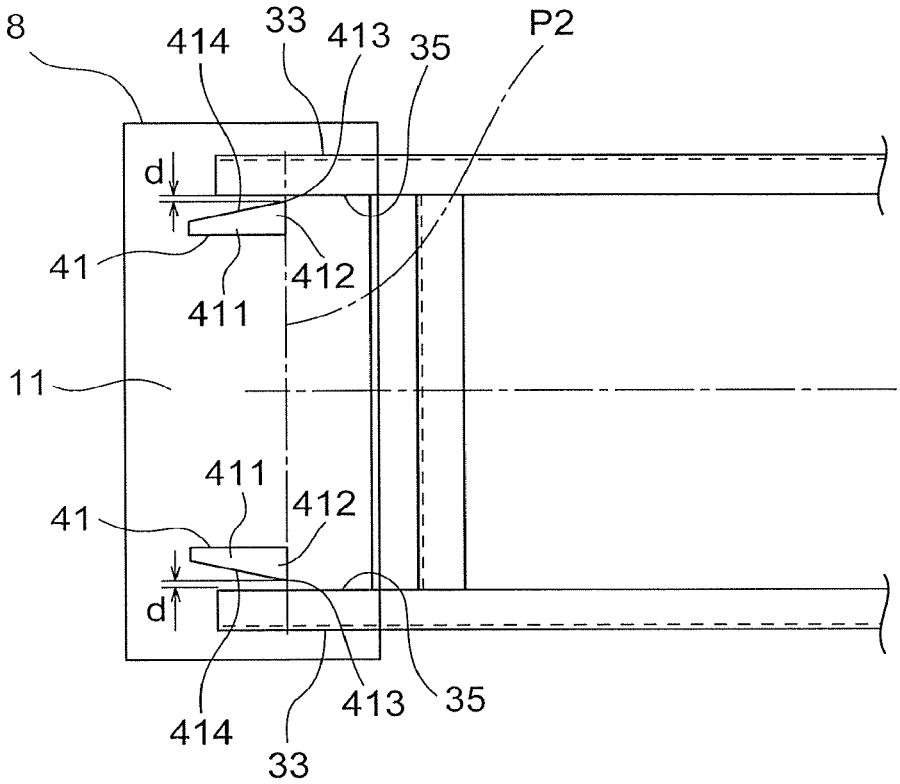
FIG. 14 is a top view for illustrating lower end portions of the truss of the escalator and a lower truss support device according to the second embodiment of the present invention.
Figure 15:
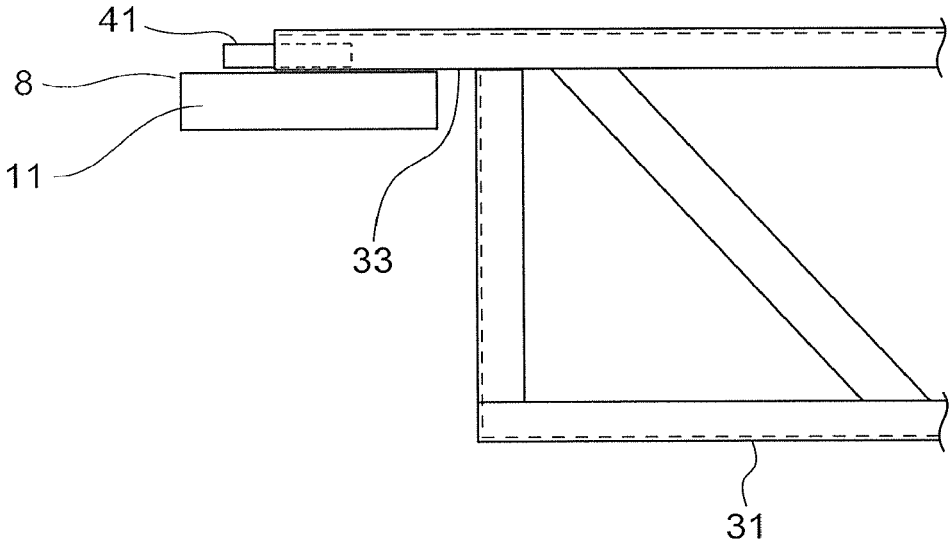
FIG. 15 is a side view for illustrating the lower end portions of the truss and the lower truss support device of FIG. 14.

FIG. 14 is a top view for illustrating the lower end portions of the truss 3 and the lower truss support device 8 for an escalator according to the second embodiment of the present invention. Further, FIG. 15 is a side view for illustrating the lower end portions of the truss 3 and the lower truss support device 8 of FIG. 14. The configuration of the lower truss support device 8 is the same as that of the lower truss support device 8 according to the first embodiment except for the pair of stopper members 41.

The configuration of the pair of stopper members 41 of the lower truss support device 8 is the same as that of the pair of stopper members 41 of the upper truss support device 7. Further, the positional relationship of the pair of stopper members 41 of the lower truss support device 8 with respect to the setting straight line P2 is the same as that of the pair of stopper members 41 of the upper truss support device 7 with respect to the setting straight line P1.

In the lower truss support device 8, the pair of stopper members 41 are fixed to the upper surface of the bearing plate 11 so that the reference end portions 413 are directed in directions opposite to each other in the direction along the setting straight line P2. In this example, the pair of stopper members 41 are fixed to the upper surface of the bearing plate 11 so that the reference end portions 413 are directed outward in the direction along the setting straight line P2. The pair of stopper members 41 are arranged between the pair of lower engaging portions 33. In the receiving portion 412 of the lower truss support device 8, a ridge line, at which the reference flat surface and the inclined surface 414 cross each other, forms the reference end portion 413. Therefore, in the same manner as in the upper truss support device 7, when the abutment surface 35 of the lower engaging portion 33 is brought into contact with the reference end portion 413, the abutment surface 35 and the reference end portion 413 are put into a line contact state.

Also in the lower truss support device 8, in the same manner as in the upper truss support device 7, the gaps d are present between the reference end portion 413 of the one stopper member 41 and the one abutment surface 35 and between the reference end portion 413 of the other stopper member 41 and the other abutment surface 35, respectively. In this example, the sizes of the gaps d are equal to each other. In the lower truss support device 8, the inclined surface 414 is inclined with respect to the setting straight line P2. Therefore, the gap d between the abutment surface 35 and the reference end portion 413 is smallest, and the gap between the abutment surface 35 and the inclined surface 414 continuously increases as being separated from the reference end portion 413. The size of each of the gaps d in the lower truss support device 8 is set to be from 3 mm to 5 mm for a building having the interlayer deformation angle γ of from 1/24 to 1/40. The other configurations of the lower truss support device 8 are the same as those of the first embodiment.

Figure 16:
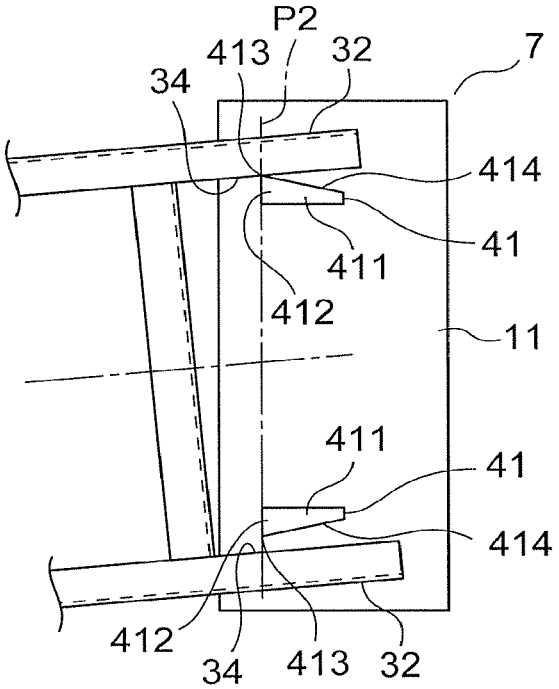
FIG. 16 is a top view for illustrating the upper end portions of the truss and the upper truss support device of FIG. 12 when an interlayer displacement occurs between the upper building portion and the lower building portion.

Next, description is given of an operation when the interlayer displacement occurs between the upper building portion 1 and the lower building portion 2 due to, for example, an earthquake or strong wind. FIG. 16 is a top view for illustrating the upper end portions of the truss 3 and the upper truss support device 7 of FIG. 12 when the interlayer displacement occurs between the upper building portion 1 and the lower building portion 2. In the upper truss support device 7, when the interlayer displacement of the upper building portion 1 with respect to the lower building portion 2 occurs, the reference end portion 413 of the one stopper member 41 is brought into contact with the abutment surface 34 of the one upper engaging portion 32, with the result that a distance between the reference end portion 413 of the other stopper member 41 and the other upper engaging portion 32 increases as compared to the distance in a normal state. After that, when the displacement distance of the upper building portion 1 with respect to the lower building portion 2 further increases, the truss 3 rotates around the reference end portion 413 of the one stopper member 41, which is brought into contact with the abutment surface 34, and the truss 3 when viewed from above is inclined with respect to the setting straight line P1. In this case, in the upper truss support device 7, the truss 3 rotates around the reference end portion 413 of the one stopper member 41 while keeping a state in which the other upper engaging portion 32 is separated from the other stopper member 41.

Figure 17:
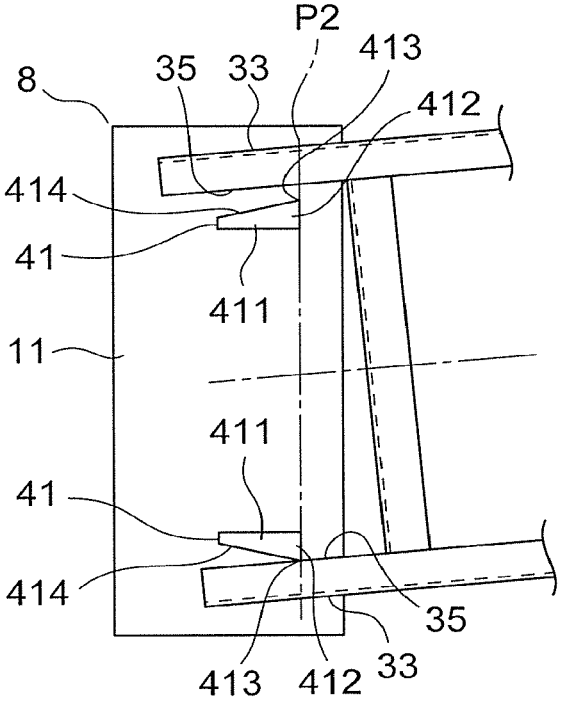
FIG. 17 is a top view for illustrating the lower end portions of the truss and the lower truss support device of FIG. 14 when the interlayer displacement occurs between the upper building portion and the lower building portion.

FIG. 17 is a top view for illustrating the lower end portions of the truss 3 and the lower truss support device 8 of FIG. 14 when the interlayer displacement occurs between the upper building portion 1 and the lower building portion 2. In the lower truss support device 8, when the interlayer displacement of the upper building portion 1 with respect to the lower building portion 2 occurs, the reference end portion 413 of the other stopper member 41 arranged at a diagonal position to the one stopper member 41 of the upper truss support device 7 is brought into contact with the abutment surface 35 of the other lower engaging portion 33, with the result that a distance between the reference end portion 413 of the one stopper member 41 and the one lower engaging portion 33 increases as compared to the distance in the normal state. After that, when the displacement distance of the upper building portion 1 with respect to the lower building portion 2 further increases, the truss 3 rotates around the reference end portion 413 of the other stopper member 41, which is brought into contact with the abutment surface 35, and the truss 3 when viewed from above is inclined with respect to the setting straight line P2. In this case, in the lower truss support device 8, the truss 3 rotates around the reference end portion 413 of the other stopper member 41 while keeping a state in which the one lower engaging portion 33 is separated from the one stopper member 41.

As described above, when the interlayer displacement of the upper building portion 1 with respect to the lower building portion 2 occurs, each of the upper engaging portions 32 and each of the lower engaging portions 33 rotate without being inhibited by each of the stopper members 41 in any of the upper truss support device 7 and the lower truss support device 8, and the truss 3 when viewed from above is inclined with respect to the setting straight lines P1 and P2.

In each of the upper truss support device 7 and the lower truss support device 8 as described above, when the bearing plate 11 is viewed from above, the dimension of the receiving portion 412 in the direction orthogonal to the setting straight line P1 or P2 set on the upper surface of the bearing plate 11 continuously decreases toward the reference end portion 413 positioned on the setting straight line P1 or P2, and the gaps d are present between the reference end portion 413 of the one stopper member 41 and the one abutment surface 34 or 35 and between the reference end portion 413 of the other stopper member 41 and the other abutment surface 34 or 35, respectively. Therefore, when the interlayer displacement of the upper building portion 1 with respect to the lower building portion 2 occurs, inhibition of the horizontal inclination of the truss 3 with respect to the setting straight line P1 or P2 by each of the stopper members 41 can be avoided, and torsion or the like of the truss 3 can be prevented from being caused by each of the stopper members 41. Thus, the breakage of the truss 3 and each of the stopper members 41 can be prevented.

Further, when the bearing plate 11 is viewed from above, the outline of the receiving portion 412 is formed of two straight lines that cross each other on the setting straight line P1 or P2, and hence the shape of the stopper member 41 can be made simple, and the stopper member 41 can easily be manufactured.

In the above-mentioned example, when the bearing plate 11 is viewed from above, the reference flat surface formed on the receiving portion 412 of the upper truss support device 7 overlaps the setting straight line P1, but the reference flat surface of the receiving portion 412 may be inclined with respect to the setting straight line P1.

In the above-mentioned example, when the bearing plate 11 is viewed from above, the reference flat surface formed on the receiving portion 412 of the lower truss support device 8 overlaps the setting straight line P2, but the reference flat surface of the receiving portion 412 may be inclined with respect to the setting straight line P2.

Further, in the above-mentioned example, the reference end portion 413 of the upper truss support device 7 forms the ridge line at which the inclined surface 414 and the reference flat surface of the stopper member 41 cross each other, but an end surface facing the abutment surface 34 may be formed on the reference end portion 413 of the upper truss support device 7. In this case, the end surface formed on the reference end portion 413 may be formed into a flat surface orthogonal to the setting straight line P1.

Further, in the above-mentioned example, the reference end portion 413 of the lower truss support device 8 forms the ridge line at which the inclined surface 414 and the reference flat surface of the stopper member 41 cross each other, but an end surface facing the abutment surface 35 may be formed on the reference end portion 413 of the lower truss support device 8. In this case, the end surface formed on the reference end portion 413 may be formed into a flat surface orthogonal to the setting straight line P2.

Further, in the above-mentioned example, the pair of stopper members 41 of the upper truss support device 7 are arranged between the pair of upper engaging portions 32, but the pair of stopper members 41 may be arranged on outer sides of the pair of upper engaging portions 32 in the width direction. That is, the pair of upper engaging portions 32 may be inserted between the pair of stopper members 41. In this case, the pair of abutment surfaces 34 of the pair of upper engaging portions 32 are arranged so as to be directed to the outer sides of the truss 3 in the width direction. Further, the pair of stopper members 41 are fixed to the upper surface of the bearing plate 11 so that the reference end portions 413 are directed inward in the direction along the setting straight line P1.

Further, in the above-mentioned example, the pair of stopper members 41 of the lower truss support device 8 are arranged between the pair of lower engaging portions 33, but the pair of stopper members 41 may be arranged on outer sides of the pair of lower engaging portions 33 in the width direction. That is, the pair of lower engaging portions 33 may be inserted between the pair of stopper members 41. In this case, the pair of abutment surfaces 35 of the pair of lower engaging portions 33 are arranged so as to be directed to the outer sides of the truss 3 in the width direction. Further, the pair of stopper members 41 are fixed to the upper surface of the bearing plate 11 so that the reference end portions 413 are directed inward in the direction along the setting straight line P2.

Further, in the above-mentioned example, the gaps d are present between the reference end portion 413 of the one stopper member 41 and the one abutment surface 34 or 35 and between the reference end portion 413 of the other stopper member 41 and the other abutment surface 34 or 35, respectively. However, the gap may be present only between the reference end portion 413 of the one stopper member 41 and the one abutment surface 34 or 35 or only between the reference end portion 413 of the other stopper member 41 and the other abutment surface 34 or 35.

Third Embodiment

Figure 18:
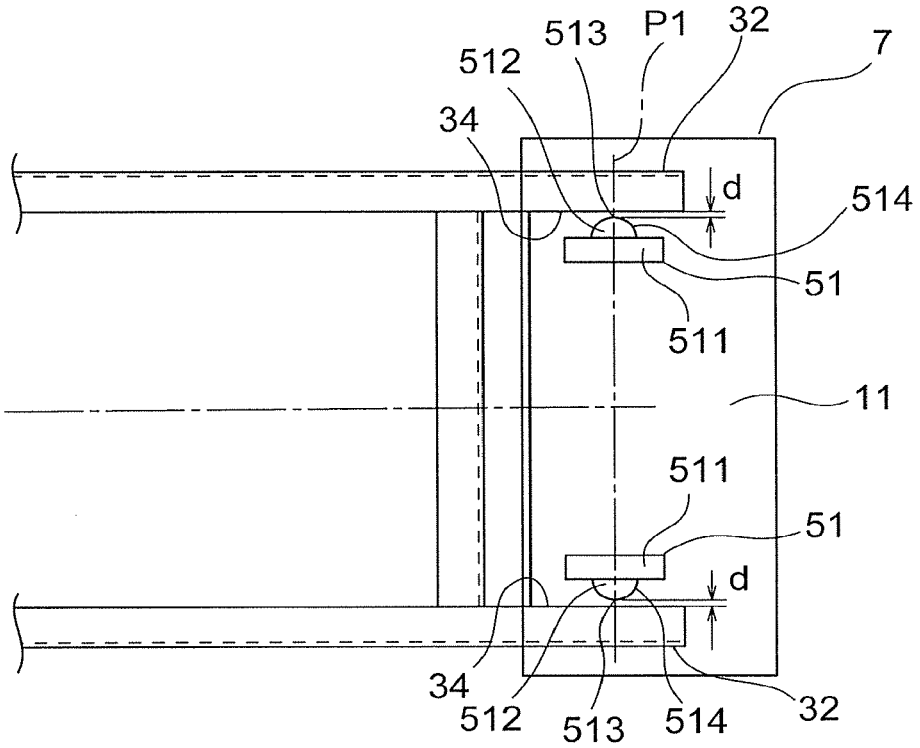
FIG. 18 is a top view for illustrating upper end portions of a truss of an escalator and an upper truss support device according to a third embodiment of the present invention.
Figure 19:
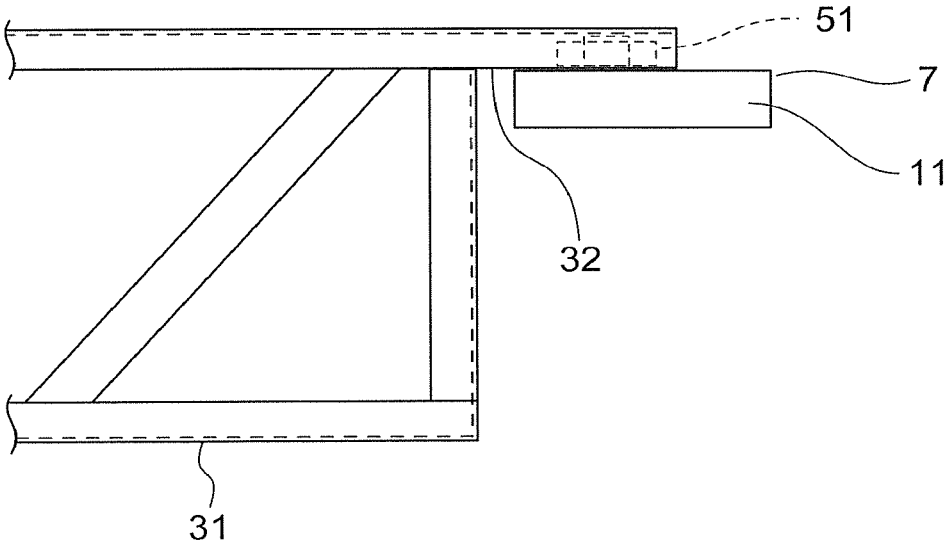
FIG. 19 is a side view for illustrating the upper end portions of the truss and the upper truss support device of FIG. 18.

FIG. 18 is a top view for illustrating upper end portions of a truss and an upper truss support device for an escalator according to a third embodiment of the present invention. Further, FIG. 19 is a side view for illustrating the upper end portions of the truss and the upper truss support device of FIG. 18. The upper truss support device 7 includes the bearing plate 11 being a support member and a pair of stopper members 51 being a pair of displacement restricting members fixed to the bearing plate 11. The configuration of the upper truss support device 7 is the same as that of the upper truss support device 7 according to the first embodiment except for the pair of stopper members 51.

The pair of stopper members 51 each include a main body portion 511 and a receiving portion 512 formed on a side surface of the main body portion 511. The stopper member 51 may be formed as a single member by integrally forming the main body portion 511 and the receiving portion 512 or may be formed by forming the main body portion 511 and the receiving portion 512 as separate members and thereafter integrating the main body portion 511 and the receiving portion 512 with each other. The main body portion 511 has a rectangular box shape. When the bearing plate 11 is viewed from above, the main body portion 511 is arranged so that a side surface of the rectangular box of the main body portion 511 is orthogonal to the setting straight line P1.

When the bearing plate 11 is viewed from above, the receiving portion 512 includes a reference end portion 513 positioned on the setting straight line P1. In the upper truss support device 7, when the bearing plate 11 is viewed from above, the dimension of the receiving portion 512 in the direction orthogonal to the setting straight line P1 continuously decreases toward the reference end portion 513.

In the receiving portion 512, a curved surface 514 extending from the reference end portion 513 is formed toward the abutment surface 34. In this example, the curved surface 514 is a surface orthogonal to the upper surface of the bearing plate 11, and the receiving portion 512 has a shape obtained by halving a cylinder with a flat surface along a height direction thereof. With this, in the stopper member 51, when the bearing plate 11 is viewed from above, the curved line representing the curved surface 514 forms an outline of the receiving portion 512, and the outline of the receiving portion 512 forms an arc that crosses the setting straight line P1 in the reference end portion 513. When the bearing plate 11 is viewed from above, the center of the arc representing the curved surface 514 is positioned on the setting straight line P1.

The pair of stopper members 51 are fixed to the upper surface of the bearing plate 11 so that the reference end portions 513 are directed in directions opposite to each other in the direction along the setting straight line P1. In this example, the pair of stopper members 51 are fixed to the upper surface of the bearing plate 11 so that the reference end portions 513 are directed outward in the direction along the setting straight line P1. The pair of stopper members 51 are arranged between the pair of upper engaging portions 32. In the receiving portion 512 of the upper truss support device 7, when the abutment surface 34 of the upper engaging portion 32 is brought into contact with the reference end portion 513 or the curved surface 514, the abutment surface 34 is put into a line contact state with respect to the reference end portion 513 or the curved surface 514.

The gaps d are present between the reference end portion 513 of one stopper member 51 and the one abutment surface 34 and between the reference end portion 513 of the other stopper member 52 and the other abutment surface 34, respectively. In this example, the sizes of the gaps d are equal to each other. In the upper truss support device 7, the gap d between the abutment surface 34 and the reference end portion 513 is smallest, and the gap between the abutment surface 34 and the curved surface 514 continuously increases as being separated from the reference end portion 513. The size of each of the gaps d in the upper truss support device 7 is set to be from 3 mm to 5 mm for a building having the interlayer deformation angle γ of from 1/24 to 1/40. The other configurations of the upper truss support device 7 are the same as those of the first embodiment.

Figure 20:
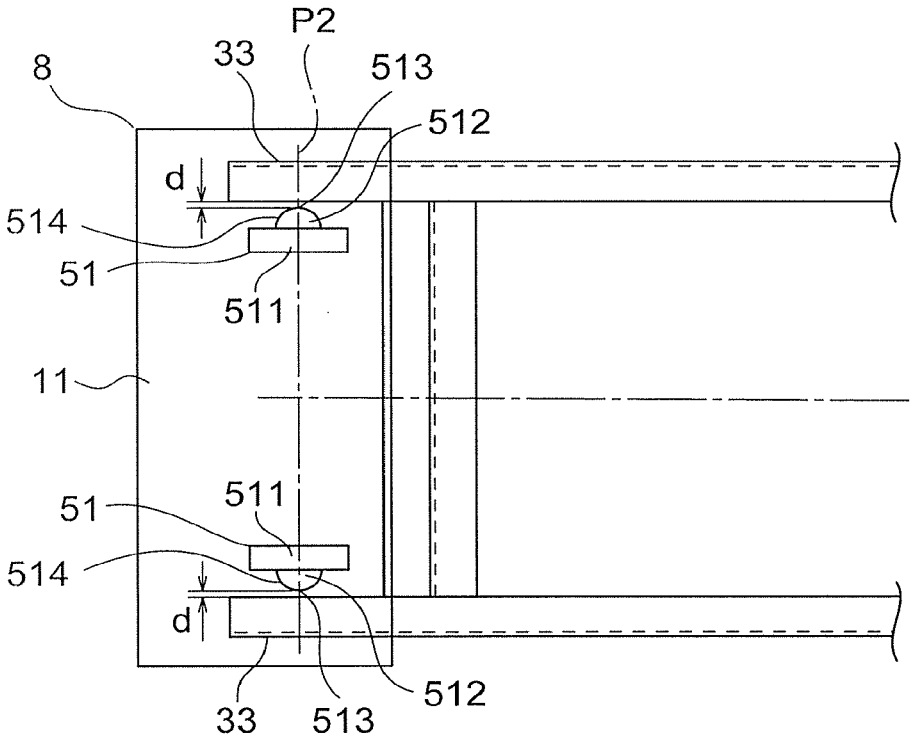
FIG. 20 is a top view for illustrating lower end portions of the truss of the escalator and a lower truss support device according to the third embodiment of the present invention.
Figure 21:
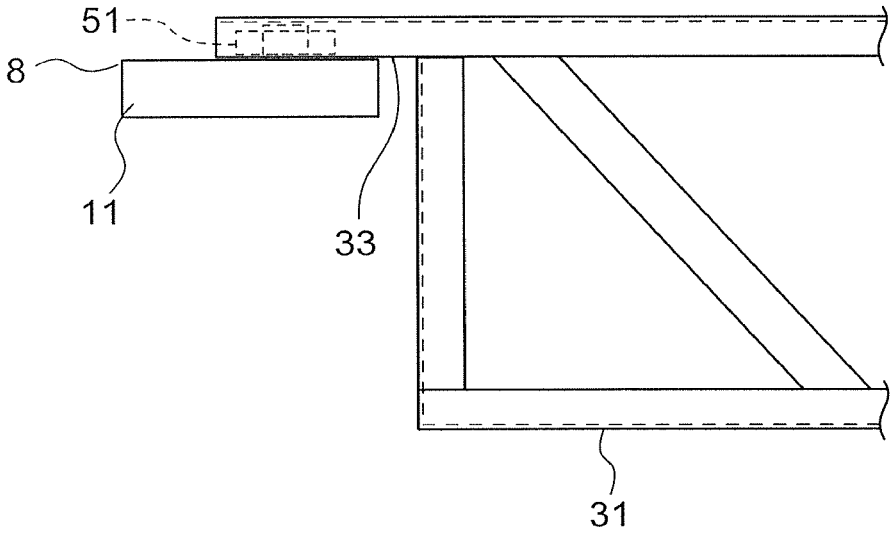
FIG. 21 is a side view for illustrating the lower end portions of the truss and the lower truss support device of FIG. 20.

FIG. 20 is a top view for illustrating lower end portions of the truss 3 and the lower truss support device 8 for an escalator according to the third embodiment of the present invention. Further, FIG. 21 is a side view for illustrating the lower end portions of the truss 3 and the lower truss support device 8 of FIG. 20. The configuration of the lower truss support device 8 is the same as that of the lower truss support device 8 according to the first embodiment except for the pair of stopper members 51.

The configuration of the pair of stopper members 51 of the lower truss support device 8 is the same as that of the pair of stopper members 51 of the upper truss support device 7. Further, the positional relationship of the pair of stopper members 51 of the lower truss support device 8 with respect to the setting straight line P2 is the same as that of the pair of stopper members 51 of the upper truss support device 7 with respect to the setting straight line P1.

In the lower truss support device 8, the pair of stopper members 51 are fixed to the upper surface of the bearing plate 11 so that the reference end portions 513 are directed in directions opposite to each other in the direction along the setting straight line P2. In this example, the pair of stopper members 51 are fixed to the upper surface of the bearing plate 11 so that the reference end portions 513 are directed outward in the direction along the setting straight line P2. The pair of stopper members 51 are arranged between the pair of lower engaging portions 33. In the receiving portion 512 of the lower truss support device 8, the curved surface 514 is formed on the receiving portion 512 in the same manner as in the upper truss support device 7. Therefore, when the abutment surface 35 of the lower engaging portion 33 is brought into contact with the reference end portion 513 or the curved surface 514, the abutment surface 35 is put into a line contact state with respect to the reference end portion 513 or the curved surface 514.

Also in the lower truss support device 8, in the same manner as in the upper truss support device 7, the gaps d are present between the reference end portion 513 of the one stopper member 51 and the one abutment surface 35 and between the reference end portion 513 of the other stopper member 51 and the other abutment surface 35, respectively. In this example, the sizes of the gaps d are equal to each other. In the lower truss support device 8, the gap d between the abutment surface 35 and the reference end portion 513 is smallest, and the gap between the abutment surface 35 and the inclined surface 514 continuously increases as being separated from the reference end portion 513. The size of each of the gaps d in the lower truss support device 8 is set to be from 3 mm to 5 mm with for a building having the interlayer deformation angle γ of from 1/24 to 1/40. The other configurations of the lower truss support device 8 are the same as those of the first embodiment.

Figure 22:
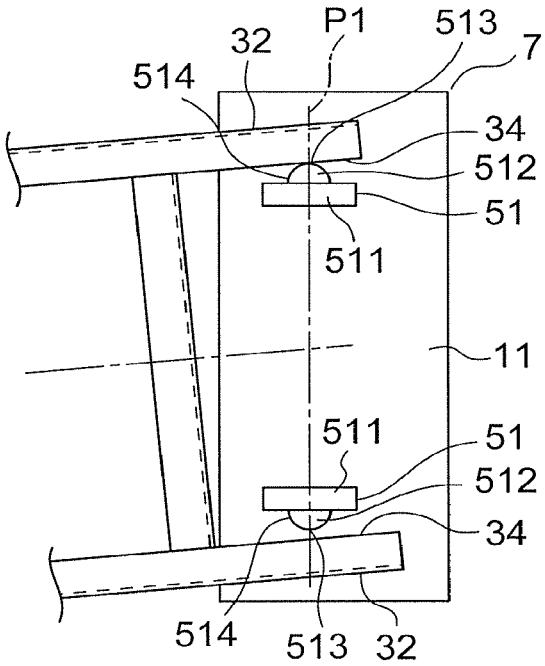
FIG. 22 is a top view for illustrating the upper end portions of the truss and the upper truss support device of FIG. 18 when an interlayer displacement occurs between the upper building portion and the lower building portion.

Next, description is given of an operation when the interlayer displacement occurs between the upper building portion 1 and the lower building portion 2 due to, for example, an earthquake or strong wind. FIG. 22 is a top view for illustrating the upper end portions of the truss 3 and the upper truss support device 7 of FIG. 18 when the interlayer displacement occurs between the upper building portion 1 and the lower building portion 2. In the upper truss support device 7, when the interlayer displacement of the upper building portion 1 with respect to the lower building portion 2 occurs, the reference end portion 513 of the one stopper member 51 is brought into contact with the abutment surface 34 of the one upper engaging portion 32, with the result that a distance between the reference end portion 513 of the other stopper member 51 and the other upper engaging portion 32 increases as compared to the distance in a normal state. After that, when the displacement distance of the upper building portion 1 with respect to the lower building portion 2 further increases, the truss 3 rotates while the one abutment surface 34 is brought into contact with the curved surface 514 of the one stopper member 51, and the truss 3 when viewed from above is inclined with respect to the setting straight line P1. In this case, in the upper truss support device 7, a state is kept in which the abutment surface 34 of the other upper engaging portion 32 is separated from the other stopper member 51.

Figure 23:
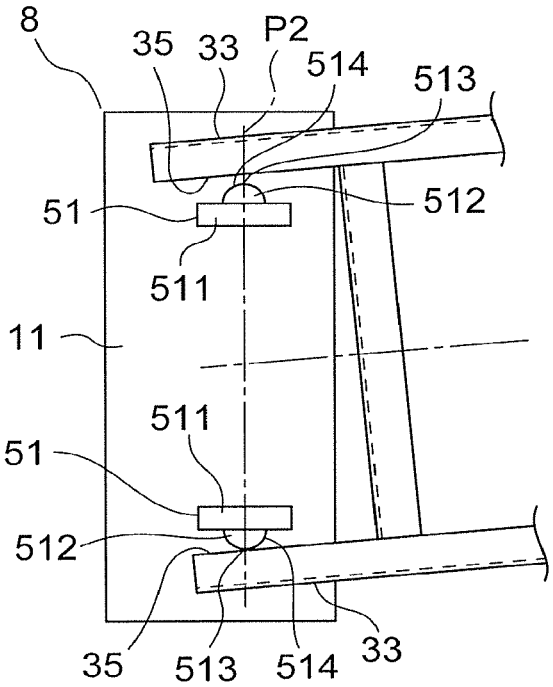
FIG. 23 is a top view for illustrating the lower end portions of the truss and the lower truss support device of FIG. 20 when the interlayer displacement occurs between the upper building portion and the lower building portion.

FIG. 23 is a top view for illustrating the lower end portions of the truss 3 and the lower truss support device 8 of FIG. 20 when the interlayer displacement occurs between the upper building portion 1 and the lower building portion 2. In the lower truss support device 8, when the interlayer displacement of the upper building portion 1 with respect to the lower building portion 2 occurs, the reference end portion 513 of the other stopper member 51 arranged at a diagonal position to the one stopper member 51 of the upper truss support device 7 is brought into contact with the abutment surface 35 of the other lower engaging portion 33, with the result that a distance between the reference end portion 513 of the one stopper member 51 and the one lower engaging portion 33 increases as compared to the distance in a normal state. After that, when the displacement distance of the upper building portion 1 with respect to the lower building portion 2 further increases, the truss 3 rotates while the other abutment surface 35 is brought into contact with the curved surface 514 of the other stopper member 51, and the truss 3 when viewed from above is inclined with respect to the setting straight line P2. In this case, in the lower truss support device 8, a state is kept in which the abutment surface 35 of the one lower engaging portion 33 is separated from the one stopper member 51.

As described above, when the interlayer displacement of the upper building portion 1 with respect to the lower building portion 2 occurs, each of the upper engaging portions 32 and each of the lower engaging portions 33 rotate without being inhibited by each of the stopper members 51 in any of the upper truss support device 7 and the lower truss support device 8, and the truss 3 when viewed from above is inclined with respect to the setting straight lines P1 and P2.

As described above, even in the case where the outline of the receiving portion 512 when the bearing plate 11 is viewed from above forms the arc, when the interlayer displacement of the upper building portion 1 with respect to the lower building portion 2 occurs, inhibition of the horizontal inclination of the truss 3 with respect to the setting straight lines P1 and P2 by each of the stopper members 51 can be avoided, and torsion or the like of the truss 3 can be prevented from being caused by each of the stopper members 51. Thus, the breakage of the truss 3 and each of the stopper members 51 can be prevented. Further, the shape of the stopper member 51 can be made simple, and the stopper member 51 can also easily be manufactured.

In the above-mentioned example, an end surface facing the abutment surface 34 may be formed on the reference end portion 513 of the upper truss support device 7. In this case, the end surface formed on the reference end portion 513 may be formed into a flat surface orthogonal to the setting straight line P1.

Further, in the above-mentioned example, an end surface facing the abutment surface 35 may be formed on the reference end portion 513 of the lower truss support device 8. In this case, the end surface formed on the reference end portion 513 may be formed into a flat surface orthogonal to the setting straight line P2.

Further, in the above-mentioned example, the stopper member 51 of the upper truss support device 7 includes the main body portion 511 and the receiving portion 512. However, the main body portion 511 of the stopper member 51 may be eliminated, and the receiving portion 512 may be formed into a cylindrical shape. Further, also in the stopper member 51 of the lower truss support device 8, the main body portion 511 may be eliminated, and the receiving portion 512 may be formed into a cylindrical shape.

Further, in the above-mentioned example, the receiving portion 512 of the upper truss support device 7 has a shape obtained by halving a cylinder with a flat surface along the height direction thereof, but the receiving portion 512 of the upper truss support device 7 may be formed into a shape obtained by halving a sphere. In this case, when the abutment surface 34 is brought into contact with the receiving portion 512, the abutment surface 34 is put into a point contact state with respect to the receiving portion 512.

Further, in the above-mentioned example, the receiving portion 512 of the lower truss support device 8 has a shape obtained by halving a cylinder with a flat surface along the height direction thereof, but the receiving portion 512 of the lower truss support device 8 may be formed into a shape obtained by halving a sphere. In this case, when the abutment surface 35 is brought into contact with the receiving portion 512, the abutment surface 35 is put into a point contact state with respect to the receiving portion 512.

Figure 24:
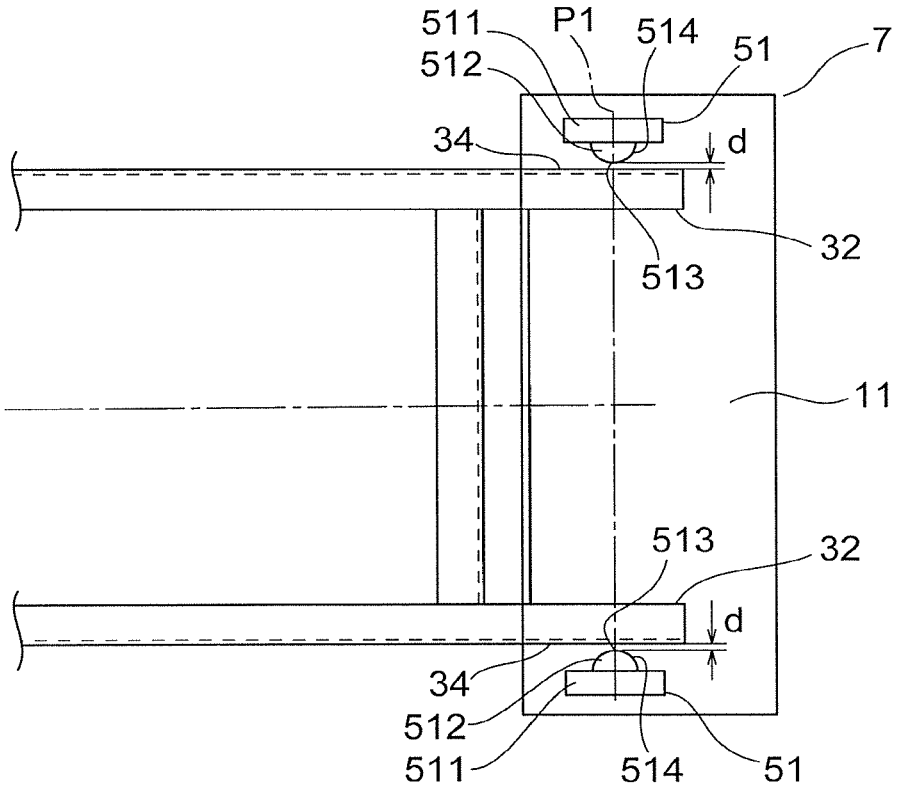
FIG. 24 is a top view for illustrating another example of the upper truss support device for an escalator according to the third embodiment of the present invention.
Figure 25:
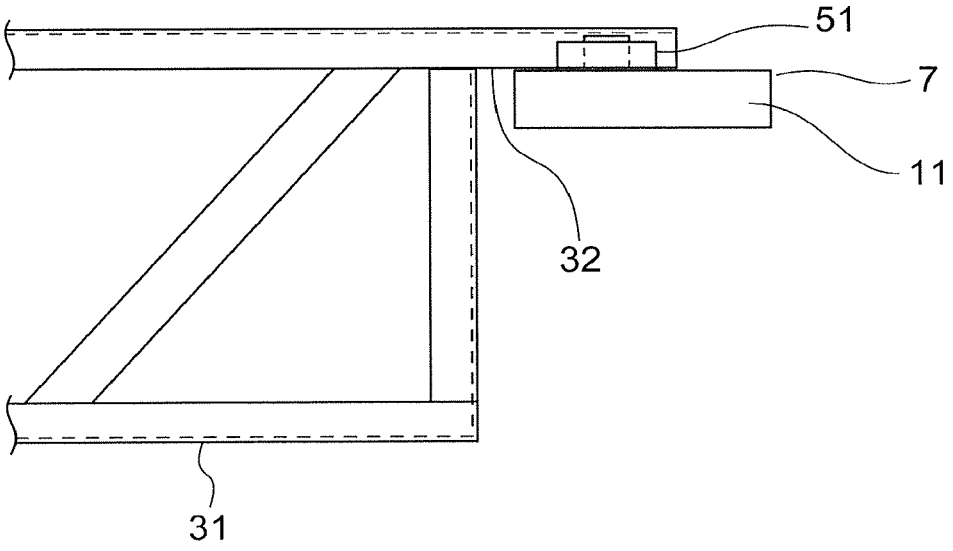
FIG. 25 is a side view for illustrating the upper truss support device of FIG. 24.

Further, in the above-mentioned example, the pair of stopper members 51 of the upper truss support device 7 are arranged between the pair of upper engaging portions 32, but the pair of stopper members 51 may be arranged on outer sides of the pair of upper engaging portions 32 in the width direction as illustrated in FIG. 24 and FIG. 25. That is, the pair of upper engaging portions 32 may be inserted between the pair of stopper members 51. In this case, the pair of abutment surfaces 34 of the pair of upper engaging portions 32 are arranged so as to be directed to the outer sides of the truss 3 in the width direction. Further, the pair of stopper members 51 are fixed to the upper surface of the bearing plate 11 so that the reference end portions 513 are directed inward in the direction along the setting straight line P1.

Further, in the above-mentioned example, the pair of stopper members 51 of the lower truss support device 8 are arranged between the pair of lower engaging portions 33, but the pair of stopper members 51 may be arranged on outer sides of the pair of lower engaging portions 33 in the width direction similarly to the upper truss support device 7. That is, the pair of lower engaging portions 33 may be inserted between the pair of stopper members 51. In this case, the pair of abutment surfaces 35 of the pair of lower engaging portions 33 are arranged so as to be directed to the outer sides of the truss 3 in the width direction. Further, the pair of stopper members 51 are fixed to the upper surface of the bearing plate 11 so that the reference end portions 513 are directed inward in the direction along the setting straight line P2.

Further, in the above-mentioned example, the gaps dare present between the reference end portion 513 of the one stopper member 51 and the one abutment surface 34 or 35 and between the reference end portion 513 of the other stopper member 51 and the other abutment surface 34 or 35, respectively. However, the gap may be present only between the reference end portion 513 of the one stopper member 51 and the one abutment surface 34 or 35 or only between the reference end portion 513 of the other stopper member 51 and the other abutment surface 34 or 35.

Further, in each of the above-mentioned embodiments, the present invention is applied to an escalator, but may be applied to a moving walkway serving as a passenger conveyor.

The invention claimed is:

1. A truss support device for a passenger conveyor, which is configured to support an end portion of a truss of a passenger conveyor, the truss support device comprising:

a support member being fixed to a building portion and having the end portion of the truss mounted thereon; and a pair of displacement restricting members including receiving portions, respectively, and being fixed to the support member, wherein, when the support member is viewed from above, the receiving portions include reference end portions, respectively, which are positioned on a setting straight line set on an upper surface of the support member, wherein the pair of displacement restricting members are fixed to the upper surface of the support member so that the reference end portions are directed in directions opposite to each other in a direction along the setting straight line, wherein the end portion of the truss include a pair of abutment surfaces facing the reference end portions, respectively, wherein, when the support member is viewed from above, each of the receiving portions has a dimension in a direction orthogonal to the setting straight line, which continuously decreases toward each of the reference end portions, and wherein the truss support device for a passenger conveyor has a gap in at least any one of a region between the reference end portion of one of the pair of displacement restricting members and one of the pair of abutment surfaces and a region between the reference end portion of another of the pair of displacement restricting members and another of the pair of abutment surfaces, wherein, when the support member is viewed from above, the each of the receiving portions has an outline that is formed of two straight lines that cross each other on the setting straight line.

2. A truss support device for a passenger conveyor according to claim 1, wherein the truss includes a truss main body and a pair of engaging portions protruding from the truss main body as the end portion of the truss, and wherein the pair of displacement restricting members are arranged on inner sides or outer sides of the pair of engaging portions in the direction along the setting straight line.

* * * * *